US010960688B2

(12) United States Patent
Byrne, III

(10) Patent No.: US 10,960,688 B2
(45) Date of Patent: Mar. 30, 2021

(54) PRINTER VACUUM CONTROL SYSTEM

(71) Applicant: Novus Printing Equipment, LLC, Roselle, IL (US)

(72) Inventor: Joe Byrne, III, Sandwich, MA (US)

(73) Assignee: Novus Printing Equipment, LLC, Roselle, IL (US)

( * ) Notice: Subject to any disclaimer, the term of this patent is extended or adjusted under 35 U.S.C. 154(b) by 6 days.

(21) Appl. No.: 15/252,482

(22) Filed: Aug. 31, 2016

(65) Prior Publication Data

US 2017/0057255 A1 Mar. 2, 2017

Related U.S. Application Data

(60) Provisional application No. 62/211,905, filed on Aug. 31, 2015.

(51) Int. Cl.
*B41J 11/00* (2006.01)

(52) U.S. Cl.
CPC ..... *B41J 11/0085* (2013.01)

(58) Field of Classification Search
CPC ..... B41J 11/0085
See application file for complete search history.

(56) References Cited

U.S. PATENT DOCUMENTS 2,317,348 A 4/1943 Wekeman
2,967,568 A 1/1961 Friday
3,328,022 A 6/1967 Miller
3,406,938 A 10/1968 Muir, Jr.
3,452,883 A 7/1969 Watters
3,652,075 A 3/1972 Thompson
3,659,818 A 5/1972 Duncan
3,729,206 A 4/1973 Cachon et al.
3,741,116 A 6/1973 Green et al.
3,763,776 A 10/1973 Jaffa
3,910,621 A 10/1975 Hillier
3,990,689 A 11/1976 Eklund, Sr.
RE29,206 E 5/1977 Jaffa
4,065,210 A 12/1977 Milburn
4,066,249 A 1/1978 Huber et al.
4,131,267 A 12/1978 Ono et al.
4,312,694 A 1/1982 Sherman et al.
4,423,676 A 1/1984 Neel
4,547,406 A 10/1985 Armstrong
4,643,093 A 2/1987 Goar et al.
4,718,629 A 1/1988 Block et al.
4,721,462 A 1/1988 Collins, Jr.
4,766,811 A 8/1988 Linska
4,984,960 A 1/1991 Szarka
5,149,045 A 9/1992 Szarka
(Continued)

FOREIGN PATENT DOCUMENTS

CA 2023419 C 9/2001
GB 2238521 B 5/1994

*Primary Examiner* — Justin Seo
(74) *Attorney, Agent, or Firm* — Greensfelder, Hemker & Gale, P.C.; Richard C. Himelhoch

(57) ABSTRACT

A printer having a vacuum system to hold down material being printed is provided. The vacuum system includes a number of vacuum holes in the printer table. Each one of these vacuum holes is individually controllable such that variously sized materials may used on the printer table and vacuum may be applied only underneath the particular material being printed on.

19 Claims, 4 Drawing Sheets

(56) References Cited

U.S. PATENT DOCUMENTS

| | | | | |
|---|---|---|---|---|
| 5,195,434 | A | 3/1993 | Hoffman | |
| 5,394,796 | A | 3/1995 | Jones et al. | |
| 5,704,385 | A * | 1/1998 | McGill | F16K 17/366 137/368 |
| 5,857,667 | A | 1/1999 | Lee | |
| 5,927,193 | A | 7/1999 | Balz et al. | |
| 6,422,548 | B1 | 7/2002 | Baber et al. | |
| 2016/0176204 | A1* | 6/2016 | Dvori | B41J 11/006 347/104 |
| 2016/0189842 | A1* | 6/2016 | Jonas | H01F 6/04 335/216 |
| 2018/0015741 | A1* | 1/2018 | Onuma | B41J 11/0065 |

* cited by examiner

PRINTER VACUUM CONTROL SYSTEM

BACKGROUND OF THE INVENTION

Field of the Invention

The present invention relates generally to printer control systems. More particularly, the present invention relates to a vacuum control system used for large printer systems.

Description of Related Art

Large ink jet printer systems typically use a vacuum system to hold the print material flat to the table, thereby preventing any contact between the material and the print heads due to warped or uneven material when the material is in a relaxed state.

The vacuum is typically supplied by a vacuum pump, or series of pumps, to the vacuum table. The vacuum table is typically a large chamber reinforced with a honeycomb structure. The print material is exposed to low pressure areas caused by vacuum drawn through a series of holes and/or channels in the top of the printer table known as vacuum holes. The vacuum holes are typically arranged in a pattern on the table to effectively hold down the material over the entire print surface. Some vacuum tables are equipped with zone controls which restricts the vacuum from certain regions of the vacuum table that are not in use, but these zones are not infinitely adjustable and can only control areas that correspond to pre-determined sheet sizes or patterns in the table.

If the active vacuum holes outside of the area covered by the print material are not mechanically restricted, then a large amount of vacuum pressure will be lost, thereby reducing the effectiveness of the hold-down forces asserted on the print material.

Another side-effect of leaving these holes unrestricted is that passing the inkjet carriage over exposed, active vacuum hole(s), will cause the ink jets to actually 'de-prime' and stop jetting ink in the print process. This effectively ruins the print and wastes both the print material as well as valuable time.

If the print material is not large enough to dimensionally cover the entirety of the active vacuum holes, (holes that are charged with vacuum), then the print operator must cover the active vacuum holes with some consumable material used to 'mask the table'. This masking process can be time consuming and quite expensive, adding costs for labor time, materials costs, and most importantly printer idle time. If a particular print shop prints on a large variety of material sizes the operator might run a print job in two or three minutes and then spend the next 30 minutes masking the table for the next job. This is not efficient, and when considering the cost of the print equipment, 'setup time' is always a major concern.

Therefore, what is needed is a device that can selectively open or close vacuum holes on an individual basis as needed without manually masking the holes, thereby reducing consumable costs and down time.

SUMMARY OF THE INVENTION

The subject matter of this application may involve, in some cases, interrelated products, alternative solutions to a particular problem, and/or a plurality of different uses of a single system or article.

In one aspect, a valve for control of a vacuum hole on a vacuum table is provided. The valve comprises a vacuum hole through which a vacuum is drawn, a slot, a restrictor movable within the slot, and an outlet connected to a vacuum source. The slot is arranged with a length approximately parallel (+/−30 degrees) to a top surface of a printer table. The slot is in communication with a vacuum hole on the printer table as well as the outlet, and is positioned along a path between the vacuum hole and outlet to the vacuum source. A restrictor, which in some aspects is magnetic, is movable within the slot. The restrictor is configured to block an air flow path through the vacuum hole and outlet when in the valve is closed, and configured to allow air flow through the vacuum hole and outlet when the valve is open. The slot has a first open side, and a second closed side, the restrictor is movable between the first open side and second closed side by action of a force moving the restrictor. In operation, when on the second closed side, the restrictor blocks an air flow between the vacuum hole and the vacuum source. When the restrictor is on the first open side, air can flow between the vacuum hole and the vacuum source to draw the vacuum.

In another aspect, a vacuum table is provided having a table with a plurality of individually controllable vacuum holes. The vacuum table has a base which supports the structure on a surface. A table is positioned on a top of the base which is configured to receive a sheet or other substrate material. A vacuum source is positioned within the base that is configured to draw an air flow through the plurality of vacuum holes of the table, each of the vacuum holes being in communication with the vacuum source. Each of the vacuum holes is controllable by a valve which may be individually opened (allow air flow through the vacuum hole) and closed (preventing flow through the vacuum hole). As such, the vacuum table can be configured to selectively draw a vacuum on different points and areas on the table on a hole by hole basis, allowing the vacuum table to use the vacuum to hold down any number of different sized substrate materials without substantial modification of the vacuum table. This provides greater ease of use, more flexibility, and less down time.

DETAILED DESCRIPTION

Figure 1:
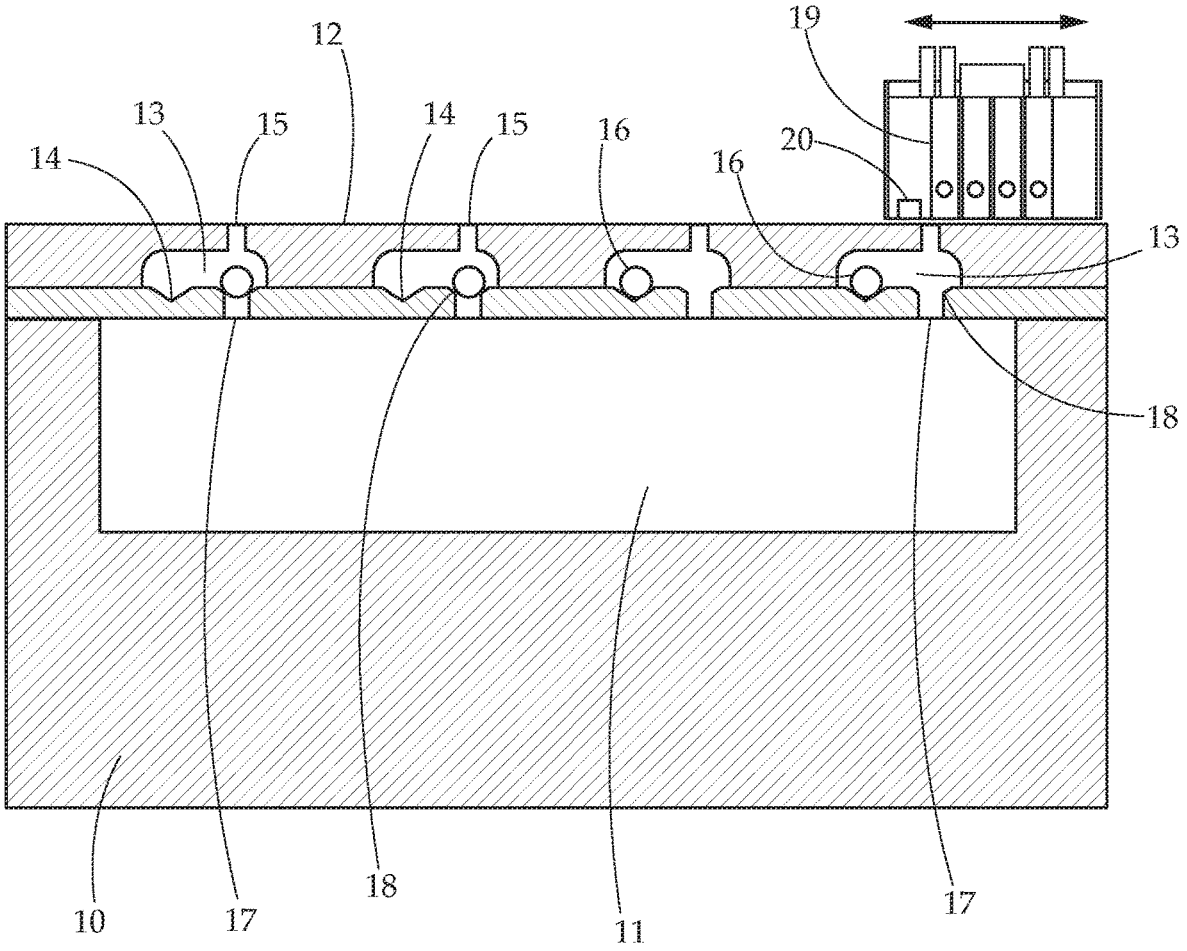
FIG. 1 provides a side cutaway view of an embodiment of a valve-controlled vacuum hole system for a printer table.

The detailed description set forth below in connection with the appended drawings is intended as a description of presently preferred embodiments of the invention and does not represent the only forms in which the present invention may be constructed and/or utilized. The description sets forth the functions and the sequence of steps for constructing and operating the invention in connection with the illustrated embodiments.

Generally, the present invention is a system capable of selectively opening or closing vacuum holes of a printer vacuum table on an individual basis as needed without manually masking the holes, thereby reducing consumable costs and down time. The system may use any number of different valve structures to open and close these vacuum holes to draw vacuum through the holes onto any material above the holes on the table. For example, magnetic systems, pressure based systems, electronically or mechanically controlled systems, flow based valves (based on an excessive or insufficient air flow through the vacuum hole), and the like may be used.

Overall, the present invention focuses on flow control, including allowing and blocking flow, of individual holes in a table having a plurality of these holes through which an air flow may be drawn by low pressure on a per hole basis. As such, one, or any number of holes on the table may be controlled, in any pattern, manner, arrangement, and set of these holes. The flow control of the plurality of holes on the per hold basis allows a substrate laid on the table to be held down against by the air flow and subsequent vacuum drawn by the one or plurality of holes. Because any of the plurality of holes on the table can be controlled, a substrate of any shape may be held down to the table without holes that are not covered by the substrate being open. This is not a possibility based on the prior art which requires masking of open holes in the case of an odd (non-rectangular) shaped substrate.

While exemplary embodiments are discussed with regards to the use of the present invention with respect to printing devices, it should be understood that this invention may be applied to any number of different systems, so long as a table having a plurality of individually controllable holes, or flow channels, used to hold a substrate to a table. For example, in addition to printers, the invention may be applied in similar embodiments to cutters, routers, laminators, screen printers, and the like.

In a particular embodiment, the present invention may use a ferrous metallic object, or other magnetically susceptible material (the restrictor) to restrict or connect the vacuum source on individual vacuum holes. In one embodiment, the restrictor is allowed to travel in a slot in such a way as to restrict the vacuum when in a first position (closed position), and when moved to a second position, to allow the free flow of air through the hole, drawing a vacuum (open position).

The restrictor may be moved from the open to closed position and vice versa by applying a magnetic field moving in the appropriate direction. The attraction of the magnetic field to the restrictor will move the restrictor to or towards the appropriate position.

In magnetic embodiments, the restrictor may be any material capable of being attracted to a magnet. For example, the restrictor may be a bare magnetic metal object or it may be coated with rubber, plastic or other material to improve the vacuum seal, prevent corrosion and the like. The restrictor may also have a magnetic coating, magnetic portions, may be formed of a material with magnetic metal dispersed throughout, and the like.

In varying embodiments, the restrictor may in the shape of a sphere, a disk, a rectangular block, or other appropriate shape.

In one embodiment, a pocket or seat may be formed in each (open, closed) position for the restrictor to sit, such that the restrictor is prevented from unintentionally moving back to the other position. In a further embodiment, the closed position may also incorporate an O-ring or other gasket to better seal the vacuum. This gasket may be, for example, on the seat or the vacuum source opening.

The magnetic field of a particular embodiment may be generated in any manner, for example, the magnetic field may be generated by a simple magnet, a rare earth magnet, electromagnet, and the like.

In one embodiment, the magnetic field from the magnetic source may be applied and articulated by the printer's carriage in such a way as to open and close the appropriate vacuum holes. This may operate such that vacuum holes are opened adjacent to the carriage, thus applying a low pressure region beneath material on a table, securing and flattening the printing surface adjacent to the carriage. Once the carriage moves away, the vacuum holes on this area will be closed, stopping application of the vacuum. Vacuum may then be drawn on another area by actuating other valves to open other vacuum holes.

Turning now to FIG. 1, a view of an embodiment of the vacuum hole control valve is shown. A printer base 10 supports vacuum table 12. The base 10 further contains a vacuum chamber or other structure capable of drawing a vacuum through openings in the table 12 (blower, air pump, and the like). In the table 12 section shown, are four vacuum holes 15. These holes 15 open to a slot 13 that forms part of a valve structure to open or close vacuum holes 15. When the vacuum hole 15 is open, it has access to the vacuum chamber 11 via opening 17.

Turning to the valve structure of this embodiment that allows control of whether the vacuum hole 15 is open to draw a vacuum or closed to prevent vacuum draw, the slot 13 can be seen to contain a restrictor 16. This restrictor 16 is movable laterally within the slot 13 such that when on a left side of the slot 13, it sits in pocket 14 which operates as a seat for the restrictor 16, and exposes opening 17 to vacuum hole 15. This position is referred to as the open position which allows air to pass through vacuum hole 15. It should be understood that in other embodiments, the pocket 14 may not be necessary or may be replaced with other structure, an angling of the slot 13, or the like without straying from the scope of the invention.

When the restrictor is moved to the right side of the slot 13 it is positioned over the vacuum chamber opening 17, and is shaped and structured to seal off this opening, preventing air from being drawn through the vacuum hole 15 to create a low pressure zone near the hole. In the embodiment shown, a depression or seat 18 similar to pocket 14 is positioned by or about the vacuum chamber opening 17. As can be seen, in the slot on a left side of the figure, the restrictor 16 is over the vacuum chamber opening, thereby making the vacuum hole 15 closed, preventing air passage through the vacuum chamber opening 17 and thus the vacuum hole 15. As can be seen, in the slot on a right side of the figure, the restrictor 16 is in an open position on the slot, sitting in pocket 14, thereby making the vacuum hole 15 open and allowing air passage through the vacuum chamber opening 17 and thus the vacuum hole 15.

In this embodiment, the restrictor 16 is shown as a spherical shape, but it should be understood that any shape may be used without straying from the scope of this invention.

The restrictor 16 may be moved between open and closed positions in any manner. In a particular embodiment, such as that shown in FIG. 1, a magnetic field caused by magnet 20, that may be on a printer carriage 19 traveling left to right may pick up the restrictor 16 from the closed position and deposit it on the open position when the restrictor 16 hits the end of the slot 13. Once in the open position, air can be drawn by the vacuum source through vacuum hole 15 via vacuum opening 17. Inversely, a magnetic field caused by magnet 20 traveling right to left may pick up the restrictor 16 from the open position and deposit it in the closed position when the restrictor 16 hits that end of the slot 13. In this position, the restrictor 16 blocks air flow through the vacuum chamber opening 17. In other embodiments, the restrictor 16 may simply be lifted or rotated away from the vacuum hole 15 or vacuum opening 17 to allow a vacuum to be drawn. As noted above, the vacuum hole 15 may be opened and closed in any manner such that the restrictor 16 can be moved between the open and closed position without straying from the scope of this invention.

Figure 2:
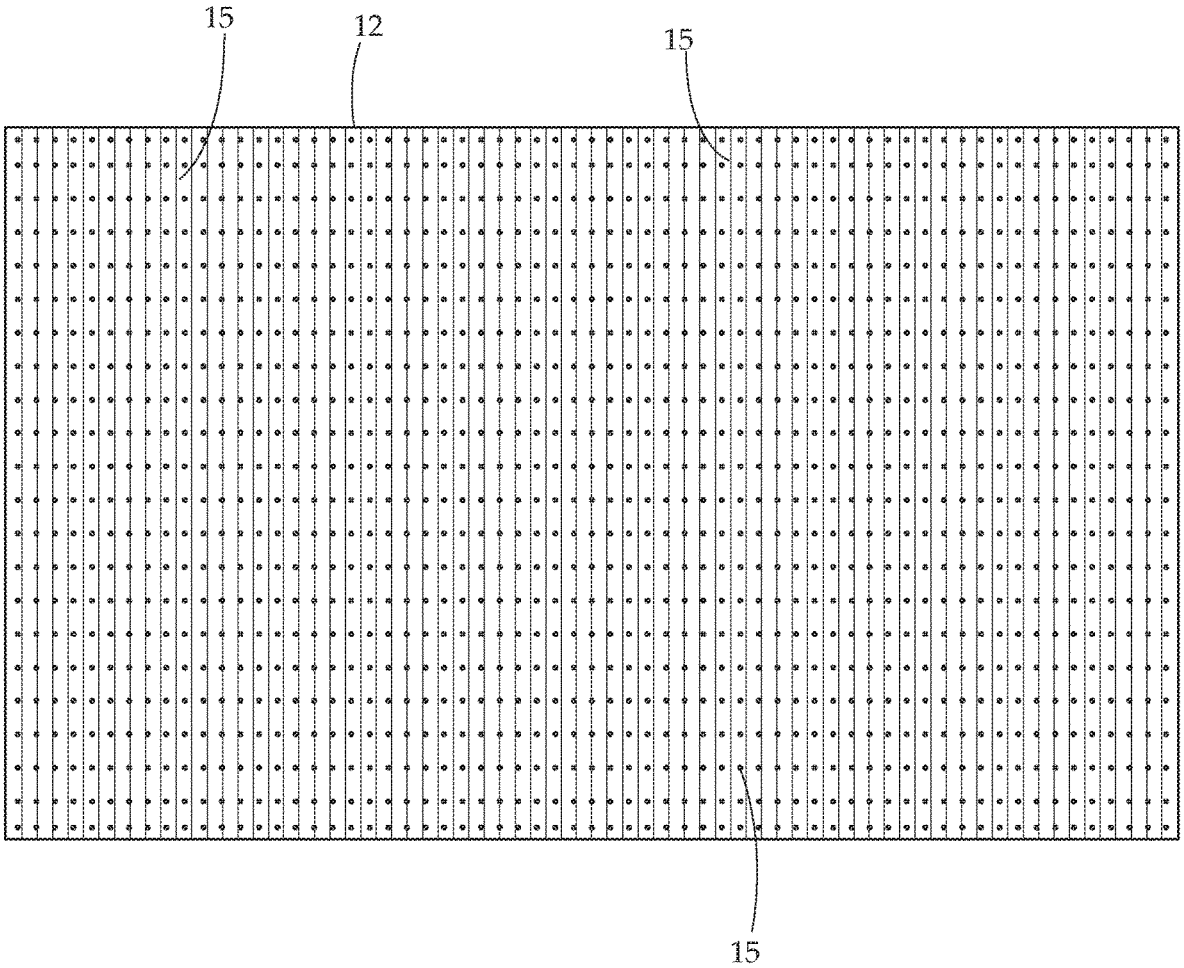
FIG. 2 provides a perspective view of a printer table having a plurality of vacuum holes, each of the vacuum holes being controllable to open and close depending on system configuration.

FIG. 2 provides a view of a vacuum table of a printer. The vacuum table 12 comprises a plurality of vacuum holes 15 arranged in a grid along its surface. These vacuum holes 15 may be arranged in any manner, and at varying spacings depending on system requirements. In one embodiment, a five foot by ten foot printer vacuum table 12 may have the vacuum holes 15 spaced at two inch intervals in a first direction, and at one inch intervals in a second direction. In the embodiment shown, each of the vacuum holes 15 is controlled by a control valve that can rapidly and selectively open the vacuum hole to draw air through it creating low pressure near the hole, or close it so that no vacuum is drawn. In other embodiments, various sets or groups of the vacuum holes 15 may be controllable together.

While an embodiment of the present invention is described with respect to a magnetic embodiment, it should be understood that any mechanical, electronic, or other means may be used to open and close the individual vacuum holes on the vacuum table. In some embodiments, a computerized controller may direct opening and closing of the various vacuum holes. This selective opening and closing may be based on the print surface/material configuration, the carriage location, both, and the like.

Figure 3:
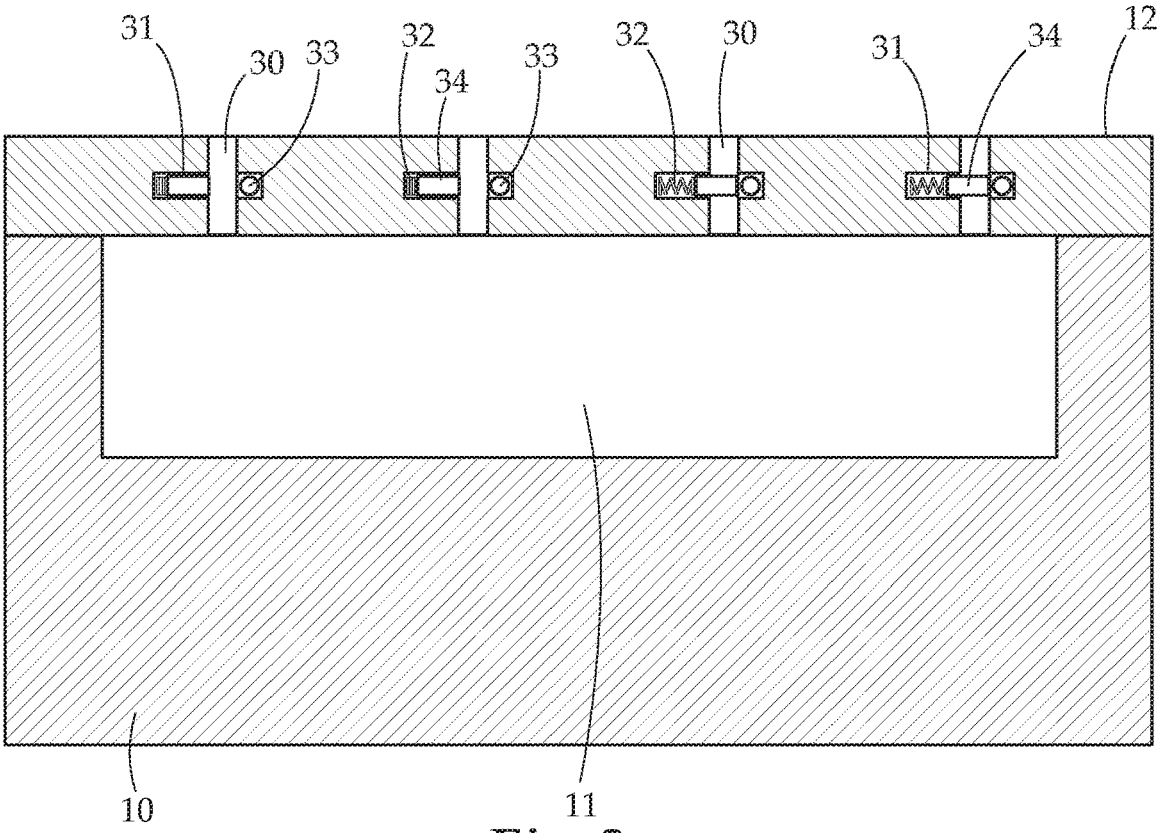
FIG. 3 provides a side cutaway view of another embodiment of a valve-controlled vacuum hole system for a printer table.
Figure 4:
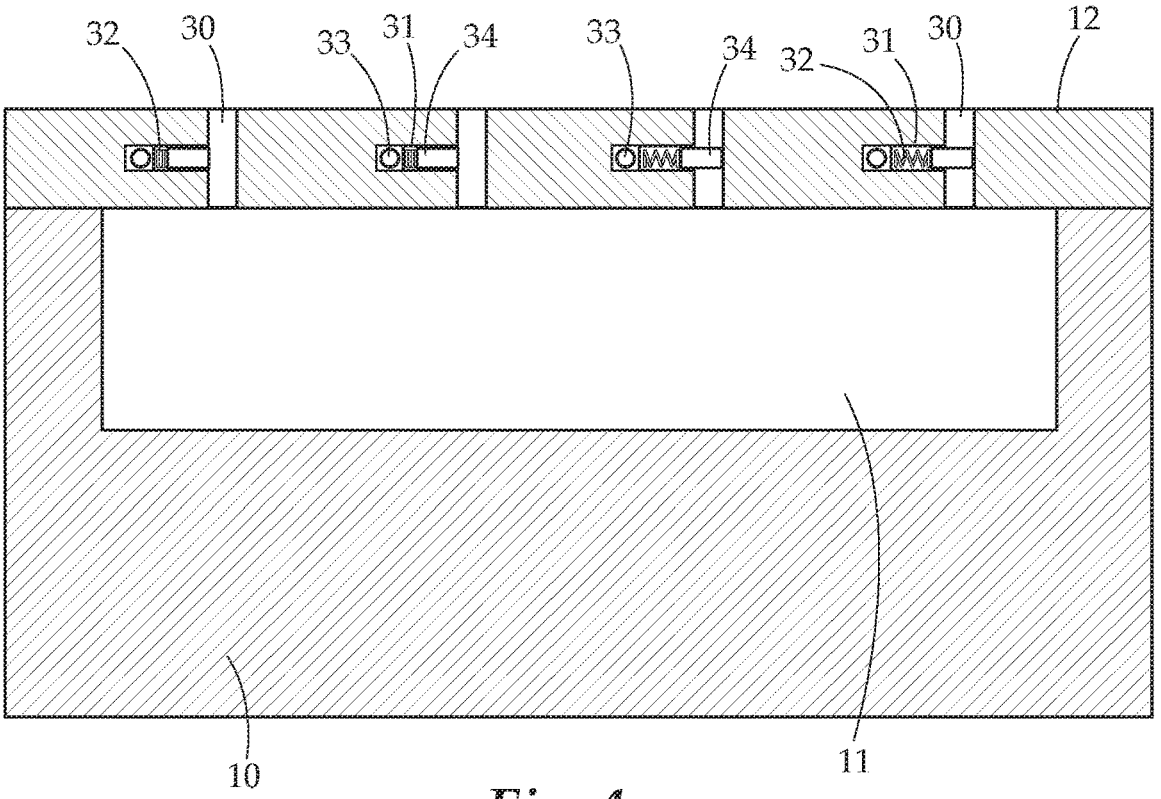
FIG. 4 provides a side cutaway view of yet another embodiment of a valve-controlled vacuum hole system for a printer table.

FIGS. 3 and 4 provide views of another embodiment of the vacuum hole control system with a somewhat similar structure, having one set of valves biased in an open position (FIG. 3), while the other shows the valves biased in a closed position (FIG. 4). In this view, printer base 10 supports vacuum table 12. The base 10 further contains a vacuum chamber 11 or other structure capable of drawing a vacuum through openings in the table 12. In the table 12 are four vacuum holes 30. These holes 30 open into, or are otherwise in communication with, the vacuum chamber 11. A slot 31 is positioned along a length of the vacuum hole 30. A restrictor 34 is positionable into the slot 31 when in an open position, and can extend out of the slot to cause a blocking of the vacuum hole 30 in a closed position. In the embodiment shown, a spring 32 draws the restrictor 34 to the open position, and an electromagnet 33 can overcome this spring force when activated to bring the restrictor 34 to the closed position. In FIG. 4, the reverse orientation is provided by spring and magnet, such that FIG. 4 shows the restrictor held in the closed position when not being acted on by the electromagnet 33. In other embodiments, the restrictor may be moved by any other means, such as a mechanical, pneumatic, electronic, or other controller.

Figure 5:
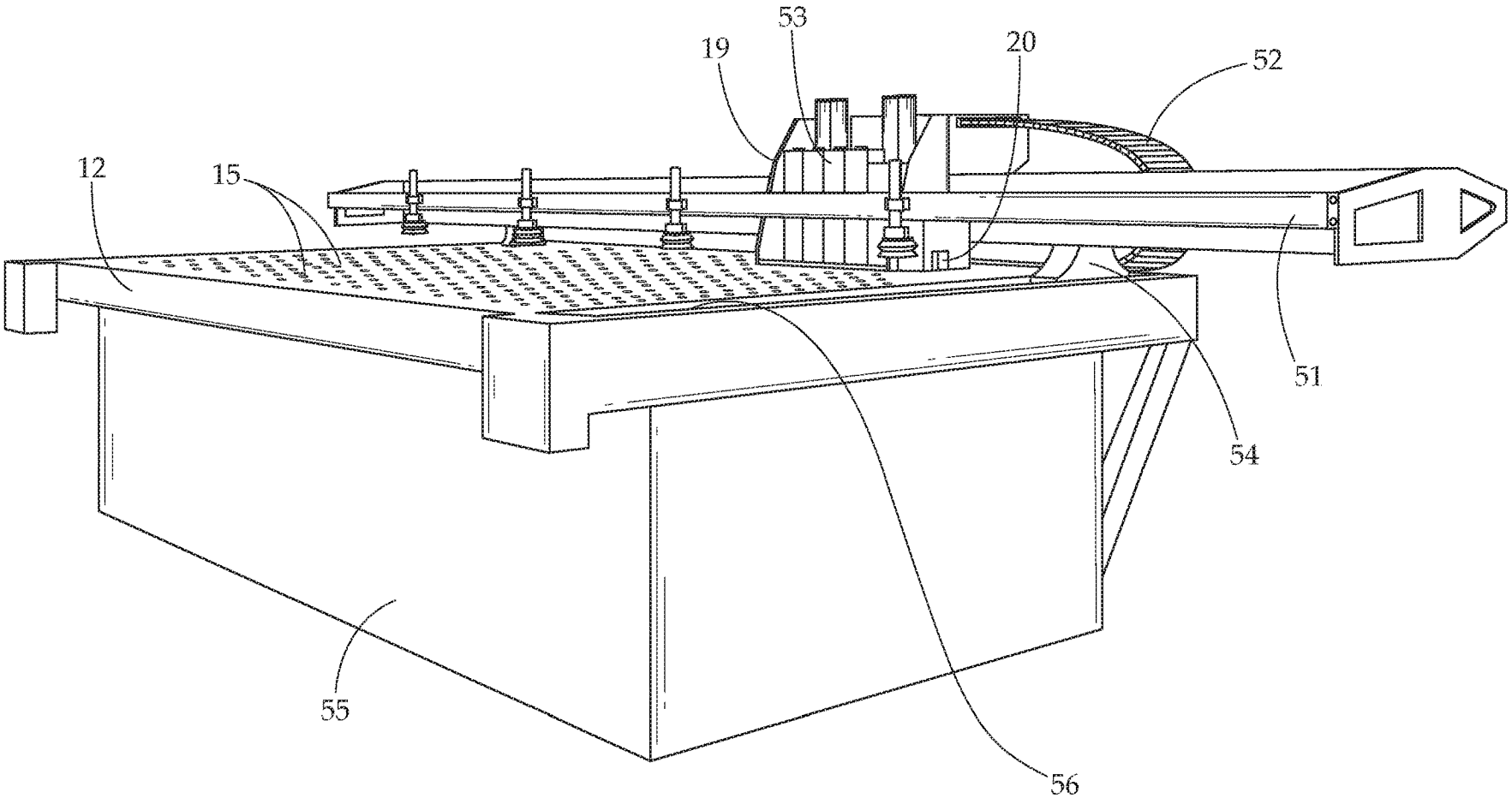
FIG. 5 provides an embodiment of a printer having a plurality of valve-controlled vacuum holes to selectively draw vacuum through certain vacuum holes and areas on the printer table.

FIG. 5 provides a perspective view of an embodiment of a printer having individually controllable vacuum holes. In this view, the printer has a base 55 on which a printer table 12 rests. On this table are a plurality of vacuum holes 15 arranged on the table. These vacuum holes 15 may be operated in any manner to selectively draw vacuum through the various holes, as discussed above. A widthwise track 56 and lengthwise track 51 allow the carriage 19 to move in widthwise and lengthwise directions along the printer table to apply markings (via ink, toner, and the like) to the material resting on the table. As noted above, in some embodiments, the carriage 19 may have a magnet 20 or other structure capable of opening or closing valves or stoppers on the individual vacuum holes 15, though other control may also be possible. In the embodiment shown, a plurality of ink or toner wells 53 are mounted on the carriage 19 to allow for depositing the marking material on the sheet resting on the table 12.

When tested, the present invention quickly proved effective. The vacuum holes opened and closed when the magnetic field was applied and the restriction was completely adequate to maintain the proper vacuum pressure to the active holes. Adjustments can be made in the size of the holes involved, the vacuum source control loop, and the alignment of the slot to the open and closed sockets depending on printer configuration and user needs.

While several variations of the present invention have been illustrated by way of example in preferred or particular embodiments, it is apparent that further embodiments could be developed within the spirit and scope of the present invention, or the inventive concept thereof. However, it is to be expressly understood that such modifications and adaptations are within the spirit and scope of the present invention, and are inclusive, but not limited to the following appended claims as set forth.

What is claimed is:

1. A vacuum table comprising:

a base, the base supporting a printer on a surface;

a table, the table attached to a top of the base and having a continuous, flat, planar surface configured to receive a sheet;

a vacuum source positioned within the base;

wherein the table comprises a plurality of individually controllable vacuum holes extending upward so that edges of the vacuum holes are flush with the continuous, flat, planar surface in an array of rows and columns having at least two adjacent vacuum holes in each row and at least two adjacent vacuum holes in each column, each vacuum hole in communication with the vacuum source, the vacuum holes configured to attract the sheet to the table when open, wherein an unobstructed portion of the planar surface of the table extends between each of the vacuum holes to prevent warping of the sheet;

a plurality of controllable valves, one of the plurality of controllable valves positioned between each of the plurality of individually controllable vacuum holes and the vacuum source;

a printing carriage having a magnet, the carriage movable about the table to dispose a marking material on the sheet;

wherein each of the plurality of controllable valves is individually controllable between an open position allowing flow through the valve, causing the vacuum hole on which the one of the plurality of control valves is positioned to communicate with the vacuum source and draw a vacuum, and a closed position preventing draw of a vacuum through the valve, and wherein each of the plurality of controllable valves includes a restrictor that is magnetically controlled upon movement of the carriage to move the restrictor.

2. The vacuum table of claim 1 wherein each of the plurality of controllable valves is mechanically controlled using a mechanical movement structure to move the valve between open and closed positions.

3. The vacuum table of claim 1 wherein each of the plurality of controllable valves is computer controlled using a computerized control system to control movement of each of the plurality of valves between the open and closed positions.

4. The printer of claim 1 wherein each of the plurality of valves are controllable such that a movement of the magnet on the carriage adjacent to one of the plurality of valves controls the valve position between the open and closed position.

5. The printer of claim 1 wherein each of the plurality of valves are controlled based on a proximity of the magnet on the carriage, such that when the carriage moves within a predetermined distance of one of the plurality of vacuum holes, the one of the plurality of valves controlling the one of the plurality of vacuum holes moves between one of the open and closed positions.

6. The vacuum table of claim 1 wherein each of the plurality of controllable valves is biased in the closed position.

7. The vacuum table of claim 1 wherein the plurality of holes are arranged in a grid across a surface of the table.

8. The valve of claim 1 wherein the magnet is an electromagnet.

9. The valve of claim 1 wherein the restrictor is biased in the open position.

10. The valve of claim 1 wherein the restrictor is biased in the closed position.

11. The valve of claim 1 wherein the restrictor seats in a pocket when in the open position.

12. The valve of claim 1 wherein the restrictor seats in a depression when in the closed position.

13. The valve of claim 11 further comprising a gasket positioned within the pocket.

14. The valve of claim 1 wherein the restrictor is formed as a sphere.

15. The valve of claim 14 wherein the spherical restrictor comprises a rubberized outer surface.

16. The vacuum table of claim 1 wherein the plurality of valves are controllable in sets of valves from the plurality of valves.

17. The vacuum table of claim 1 wherein the plurality of vacuum holes are arranged in an array of rows and columns having at least ten vacuum holes in each row and at least ten vacuum holes in each column.

18. A vacuum table comprising:

a base, the base supporting a printer;

a table, the table attached to a top of the base and configured to receive a sheet;

a vacuum source positioned within the base, wherein the table comprises a plurality of vacuum holes, each vacuum hole in communication with the vacuum source, the vacuum holes configured to attract the sheet to the table when open;

a plurality of controllable valves, one of the plurality of controllable valves positioned between each of the plurality of vacuum holes and the vacuum source;

a printing carriage having a magnet, the carriage movable about the table to dispose a marking material on the sheet wherein each of the plurality of controllable valves includes a restrictor that is magnetically controlled upon movement of the carriage between an open positioned allowing flow through the valve and a closed position preventing flow through the valve.

19. The printer of claim 18 wherein each of the plurality of valves are controlled based on a proximity of the magnet on the carriage, such that when the carriage moves within a predetermined distance of one of the plurality of vacuum holes, the one of the plurality of valves controlling the one of the plurality of vacuum holes moves between one of the open and closed positions.

* * * * *